United States Patent [19]

Farmer

[11] Patent Number: 4,717,191

[45] Date of Patent: Jan. 5, 1988

[54] SWIVEL HEAD FOR GRAPPLE

[75] Inventor: Stanley Farmer, Corbett, Oreg.

[73] Assignee: ESCO Corporation, Portland, Oreg.

[21] Appl. No.: 900,798

[22] Filed: Aug. 27, 1986

[51] Int. Cl.[4] ..... B66C 1/00

[52] U.S. Cl. ..... 294/119.4; 414/734

[58] Field of Search ..... 294/119.4, 67.5, 106, 294/86.4, 86.41; 414/734, 735; 212/146, 147, 86; 188/381; 37/183 R

[56] References Cited

U.S. PATENT DOCUMENTS 4,397,675 4/1983 Mantjaneff et al. ..... 294/119.4

*Primary Examiner*—James B. Marbert

*Attorney, Agent, or Firm*—Tilton, Fallon, Lungmus & Chestnut

[57] ABSTRACT

A swivel head for a skidding grapple incorporating a unitary body having a plate-like middle portion with a plurality of spaced apart upstading lugs and a second plurality of depending lugs, shafts installed in each of the lug pluralities for connection to the grapple head and boom clevises and with snubbing means provided on the shafts.

10 Claims, 4 Drawing Figures

SWIVEL HEAD FOR GRAPPLE

BACKGROUND AND SUMMARY OF INVENTION

This invention relates to a swivel head for a grapple and more particularly, to a head that permits 360° of rotation.

Such swivel heads have been known but have been relatively cumbersome. The inventive head, i.e., linkage, has a novel arrangement of internal components to provide longer service with less wear and is lighter and more compact. This stems from the provision of a unitary body having a plate-like middle portion with upstanding and depending intergral lugs for the receipt of rotatable shafts which are snubbed for minimal servicing.

Other objects and advantages of the invention may be seen in the details of the ensuing specification.

The invention is described in conjunction with the accompanying drawing, in which FIG. 1 is a fragmentary side elevational view, partially in section of the boom equipped grapple and featuring the inventive swivel head centrally thereof;

DETAILED DESCRIPTION

Figure 1:
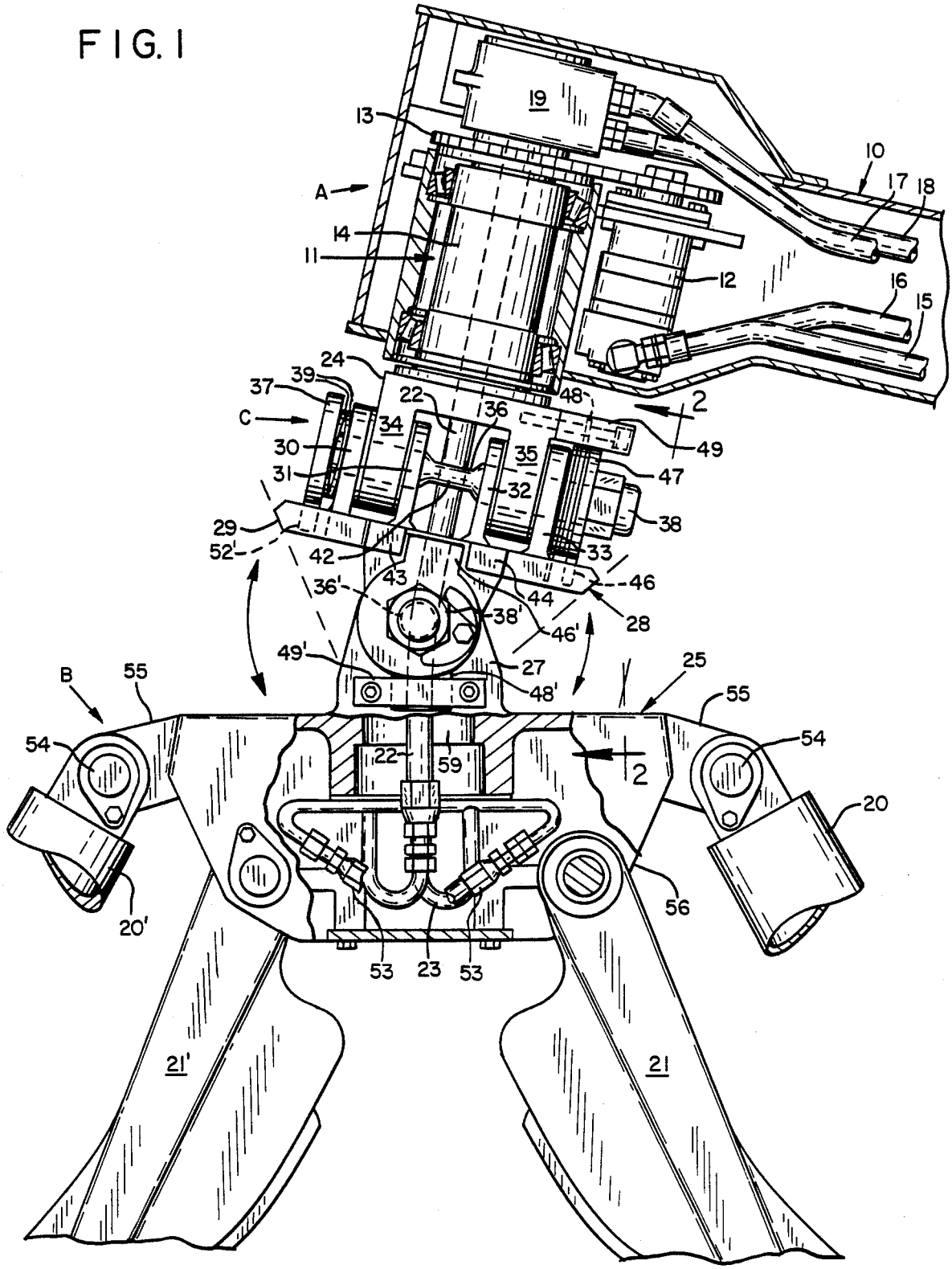

In the illustration given and with reference first to FIG. 1, the symbol A designates generally a boom, the symbol B designates the grapple and the symbol C the inventive swivel head. The boom A and grapple B may be of conventional construction and are illustrated herein to show a typical operating environment for the inventive swivel head.

The boom A is equipped with a frame 10 which is usually relatively elongated and carried by a tractor or other self propelled vehicle. For example, such equipment is used in the skidding of logs. The boom 10 is equipped with a rotation mechanism generally designated 11 and which includes a hydraulic motor 12 operating through a chain drive 13 to rotate the grapple shaft 14 through 360°. Hoses 15 and 16 provide hydraulic oil to the motor 12 for this purpose.

Other hoses 17 and 18 deliver hydraulic fluid to a swivel 19 which transmits fluid to cylinders 20 and 20' for actuating the tongs 21 and 21'. For this purpose, a pair of hoses 22 (see also the upper part of FIG. 4) run from the hydraulic swivel 19 to a tube manifold 23 in the upper part of the grapple B.

The boom swivel shaft 14 is equipped with a depending clevis 24 and the grapple upper portion is equipped with a head generally designated 25 (see also the central portion of FIG. 4) and which are generally conventional. The grapple head is equipped with a pair of lugs providing a clevis type operation and which are designated 26 and 27 in FIG. 4.

Swivel Head C

Figure 4:
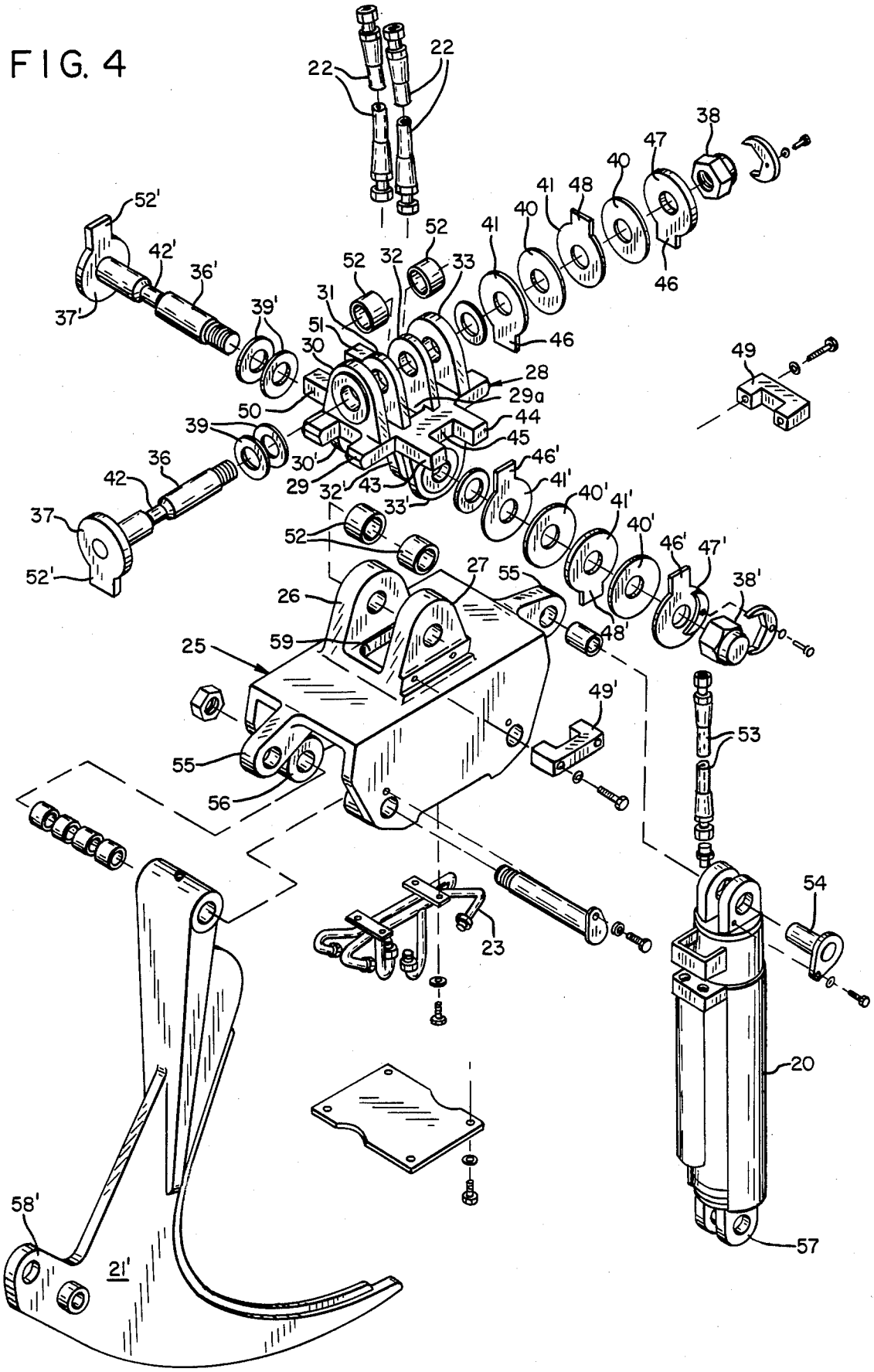
FIG. 4 is an exploded perspective view of the inventive swivel head and certain associated parts.

An important element in the swivel head C is a novel link generally designated 28 and which is seen in perspective in the upper central portion of FIG. 4.

Figure 3:
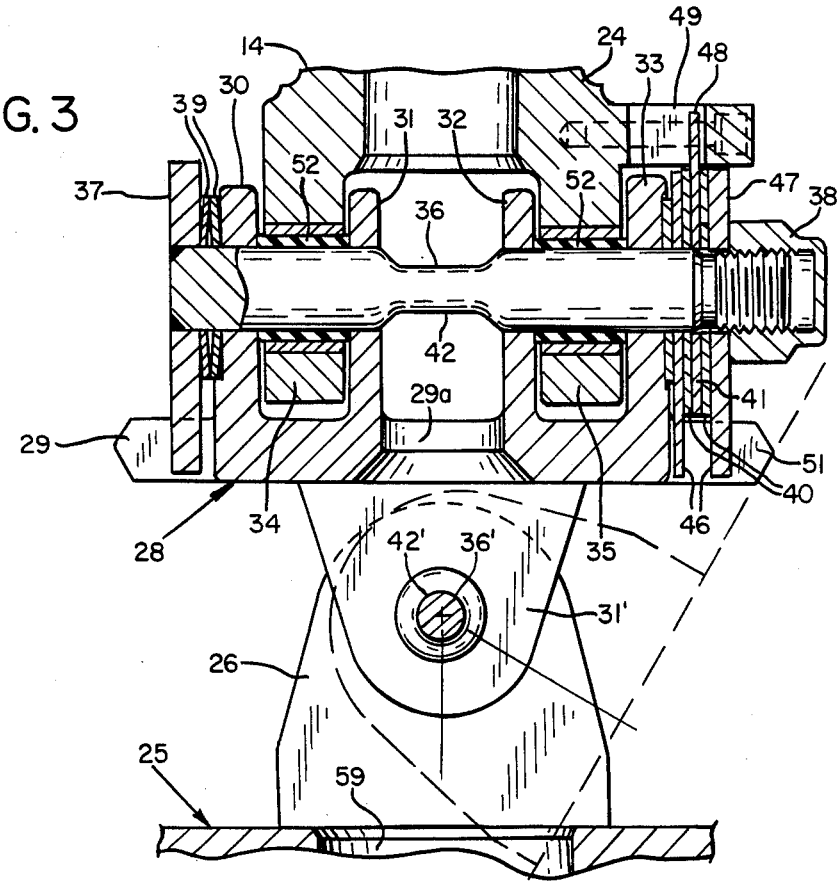
FIG. 3 is a sectional view taken along the sight line 3—3 applied to FIG. 2.
Figure 2:
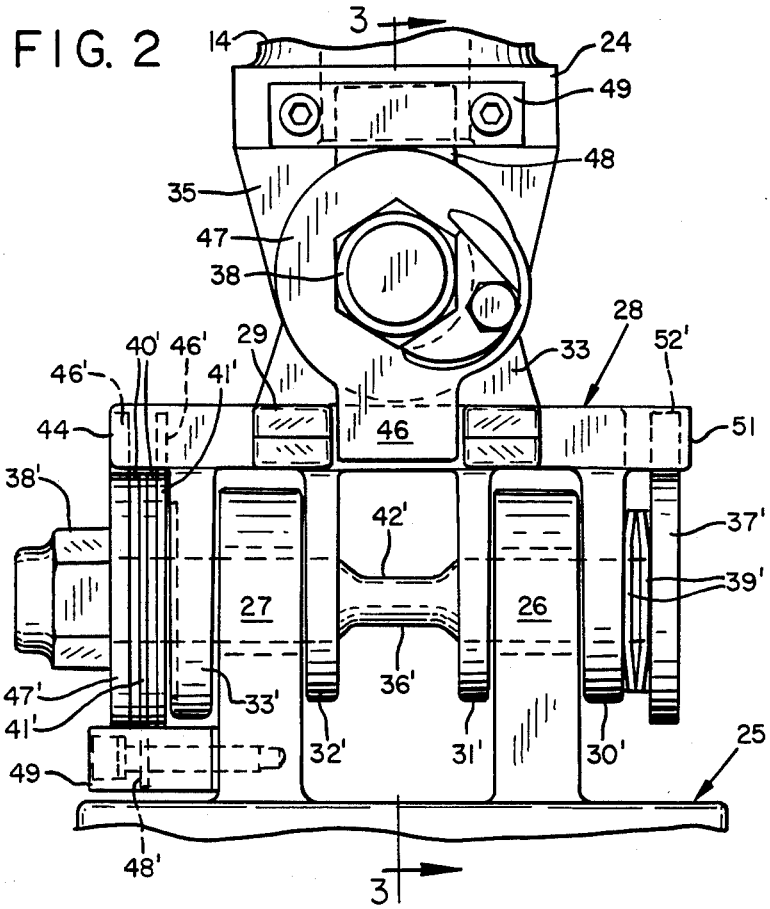
Figure 3:
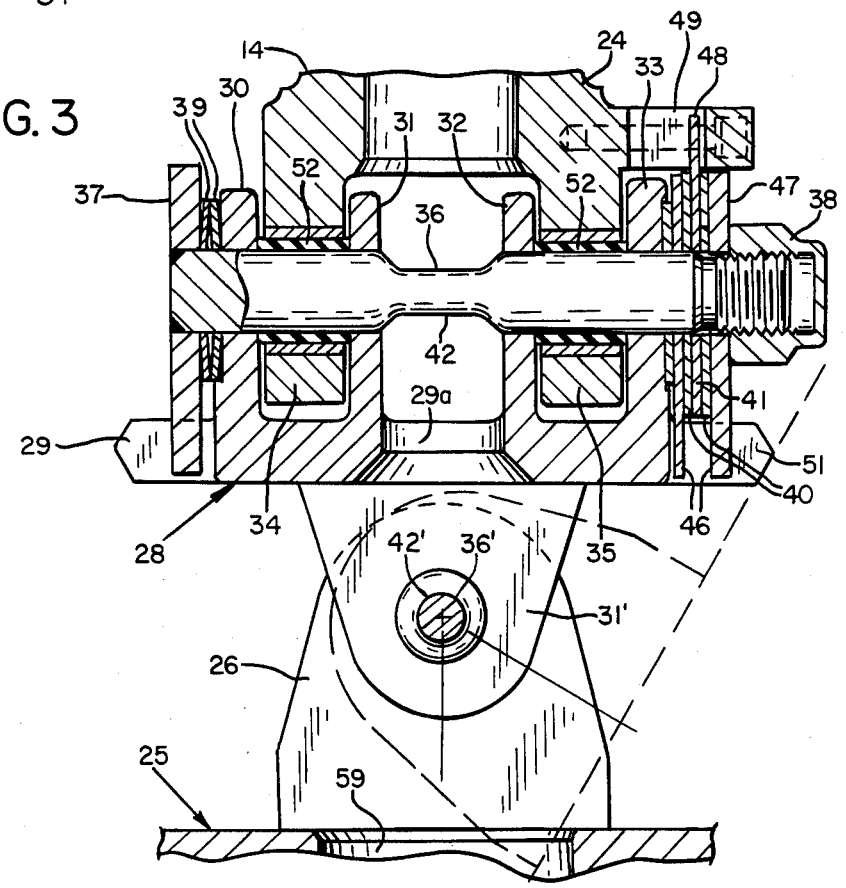

The link 28 is a unitary body having a plate-like middle portion 29 and having a central opening 29a (best seen in FIG. 3) ending there through for the passage of the hoses 22.

Upstanding from the plate-like middle portion 29 are a plurality of integral lugs 30, 31, 32 and 33.

As can be appreciated from a consideration of the central portion of FIG. 1, the lugs 30 and 31 receive one portion of the clevis 24—as at 34 while the lugs 32 and 33 receive the other portion 35 of the clevis 34. A pin 36 having an enlarged head 37 at one end extends through aligned openings within the lugs 30–33 and in the clevis portions 34 and 35 to connect the link 28 to the clevis 24. At the end of the shaft 36 opposite the head end, the shaft is equipped with a nut 38.

Interposed between the lug 30 and the head 37 of the shaft 35 are Belleville washers 39 which impart lateral pressure to the friction discs 40 which constitute snubbing means. Interposed between the lug 33 and the nut 38 are a plurality of the friction discs 40 and a plurality of spacers 41—see particularly FIG. 4.

The plate-like middle portion 29 is equipped with depending lugs which are arranged identically to those upstanding—but at right angles thereto. For convenience, these lugs and the associated parts are given the same number designations as those above the middle plate-like portion, but with the addition of a prime (').

Thus, the lug 33' (see the central portion of FIG. 4) is the one closest to the nut 38' and is spaced therefrom by the friction discs 40' and the friction spacers 41'. Again, the lugs are apertured for the receipt of the shaft 36' and, which like the shaft 36 is equipped with a central constriction as at 42, 42' so as to accommodate the passage thereby of the hoses 22.

Figure 2:
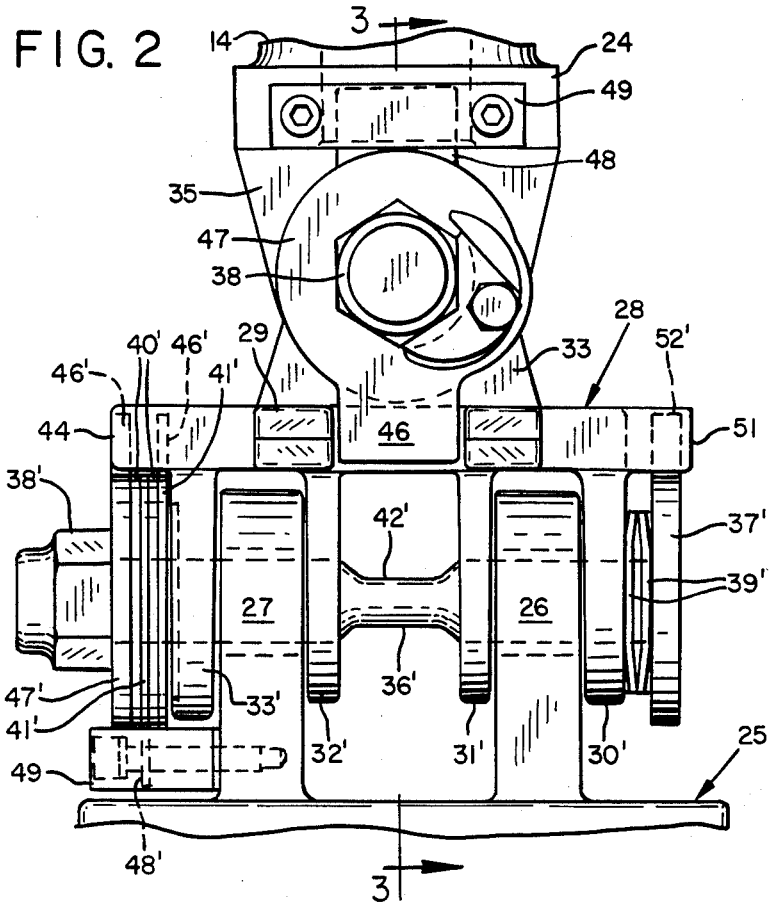
FIG. 2 is a fragmentary side elevational view of the swivel head taken at right angles to the showing in FIG. 1.

The plate-like middle portion 92 is equipped along each of its four sides with a pair of spaced apart, parallel projections as at 43 and 44 relative to the side 45 as seen in the central portion of FIG. 4. As can be appreciated from a consideration of the left central portion of FIG. 2, the projections 43 and 44 serve to capture the radial extensions 46' on the friction plate 41' and on the backup plate 47'.

Referring to FIG. 4 and in the central right hand portion, it will be noted that there is a second friction plate 41' whose radial extension 48' extends downwardly and which is captured by means of a U-shaped clip 49' engaging the grapple head 25.

In a manner analogous to the function of the projections 43 and 44, the projections 50 and 51 (see the upper left hand portion of FIG. 4) capture the upstanding radial extension 52' of the head or enlargement 37' of the shaft 36'.

The remaining two pairs of projections function in the same way relative to the shaft 36 and its associated elements as can be readily appreciated from a consideration of FIG. 4. In the case of the upstanding radial extension 48 on the middle friction plate 41 (see the upper right hand portion of FIG. 4) another U-shaped clip 49 is employed to capture and immobolize the friction plate 41. The clip 49 is bolted to the clevis 24 as can be readily appreciated from a consideration of the right hand portion of FIG. 3. The clevis 24 and, more particularly, the leg portions 34 and 35 thereof are rotatably related to the shaft 36 through the provision of bushings as at 52.

Operation

In the operation of the grapple, hydraulic fluid under pressure is provided through the hoses 17 and 18 (see the upper right hand portion of FIG. 1) to the hydraulic swivel 19. The hydraulic swivel 19 in turn delivers hydraulic fluid under pressure through the hoses 22 (see the extreme top of FIG. 4) to the manifold assembly 23 (see also the lower central portion of FIG. 4). Hydraulic fluid from the manifold assembly is then delivered via hoses 53 to the tong cylinders 20, 20'. Referring again to FIG. 4 and to the lower right hand portion, it will be seen that the tong cylinders—as at 20—are pivotally mounted by means of pins as at 54 on apertured lugs 55 provided on the sides of the grapple head 25.

The tongs 21, 21' are also pivotally mounted as at 56 on the grapple head 25 and are connected to the rod ends 57 of the tong cylinders by means of a lug extension 58'.

Before the tongs 21, 21' are closed on a load of logs the tongs can be properly oriented with the logs by rotation of the grapple head through the operation of the hydraulic motor 12 (see the right hand upper portion of FIG. 1). This is energized through the hoses 15, 16 and through the chain drive 13 rotates the grapple shaft 14 accordingly. The hoses 22 turn accordingly, being offset slightly on opposite sides of the axis of rotation and passing through the hole 29a in the link 28 and the hole 59 in the grapple head 25. In so doing, they pass by the constricted or neck down portions 42, 42' in the shafts 36, 36'.

As skidding progresses, the grapple can pivot into a mutually perpendicular direction by virtue of the swivel head C. As viewed in FIG. 1, the grapple B can swing in and out of the paper by virtue of rotating 1 by rotation around the shaft 36'. In either case, snubbing means in the form of the Belleville washers 39, 39' and the friction discs and plates 40, 41 and 40', 41' serve to dampen the swing.

Through the provision of the inventive swivel assembly, a narrower assembly has been provided than those hitherto available which makes for better visability. It is also lighter to provide for more payload. The snubbing means provided is superior to that previously available in staying tighter for a longer period and requires less adjustment so as to provide more time on the job.

While in the foregoing specification a detailed description of an embodiment of the invention has been set down for the purpose of illustration, many variations in the details hereingiven may be made by those skilled in the art without departing from the spirit and scope of the invention.

I claim:

1. A linkage for connecting the depending clevis of a boom to the upstanding clevis of the head of a hydraulic cylinder actuated grapple comprising:

a unitary body having a plate-like middle portion, said middle portion having a central opening extending therethrough for the passage of hydraulic cylinder hose means, a first plurality of spaced apart lugs upstanding from said middle portion and integral therewith, said first lugs having aligned openings for the receipt of a first shaft to releasably receive and engage the depending clevis of said boom, a first shaft in said first lugs aligned openings, said first shaft centrally of the length thereof being of restricted diameter to accommodate passage thereby of said hydraulic cylinder hose means, a second plurality of spaced apart lugs depending from said middle portion and integral therewith, said second lugs having aligned openings for the receipt of a second shaft to releasably receive and engage the upstanding clevis of said head, a second shaft in said second lugs aligned openings, said second shaft centrally of the length thereof being of restricted diameter to accommodate passage thereby of said hydraulic cylinder hose means, said first and second shafts being arranged perpendicularly of each other to provide for rotation of said grapple in two mutually perpendicular vertical arcs, each shaft extending at both ends beyond its associated lugs and equipped with snubber means in the extended portions.

2. The linkage of claim 1 in which said lugs are arranged in two sets of two each with a set of lugs being on opposite sides of said central opening.

3. A linkage for connecting the depending clevis of a boom to the upstanding clevis of the head of a hydraulic cylinder actuated grapple comprising:

a unitary body having a plate-like middle portion, said middle portion having a central opening extending therethrough for the passage of hydraulic cylinder hose means, a first plurality of spaced apart lugs upstanding from said middle portion and integral therewith, said first lugs having aligned openings for the receipt of a first shaft to releasably receive and engage the depending clevis of said boom, a first shaft in said first lugs aligned openings, said first shaft centrally of the length thereof being of restricted diameter to accommodate passage thereby of said hydraulic cylinder hose means, a second plurality of spaced apart lugs depending form said middle portion and integral therewith, said second lugs having aligned openings for the receipt of a second shaft to releasably receive and engage the upstanding clevis of said head, a second shaft in said second lugs aligned openings, said second shaft centrally of the length thereof being of restricted diameter to accommodate passage thereby of said hydraulic cylinder hose means, said first and second shafts being arranged perpendicularly of each other to provide for rotation of said grapple in two mutually perpendicular vertical arcs, each shaft extending at both ends beyond its associated lugs and equipped with snubber means in the extended portions, said lugs being arranging in two sets of two each with a set of lugs being on opposite sides of said central opening, each shaft having an enlargement at one end and a nut at the other end, said snubber means being confined between said enlargement and a lug of one set at one end and between said nut and a lug of the second set at the second end.

4. The linkage of claim 3 in which the snubber means associated with one end includes Belleville washers and that associated with the other end friction discs, said washers exerting pressure against said discs to retard grapple rotation.

5. The linkage of claim 4 in which said plate-like middle portion has a pair of spaced apart, integral projections on each side for capturing extensions on said shaft enlargement and said friction discs for immobilizing the same.

6. A 360° swivel grapple comprising:

a boom having a grapple-supporting end, a rotation mechanism in said grapple supporting end including a depending clevis and swiveling hydraulic fluid supply means, a pair of hoses depending from said fluid supply means in side-by-side relation to said clevis, a tong-equipped grapple having a head at its upper end with a clevis upstanding therefrom and with hydraulic cylinder means for actuating said tongs, a linkage connecting said boom clevis to said grapple clevis, said linkage including a plate-like middle portion having a central opening extending therethrough for the passage of said hoses, a first plurality of spaced apart lugs upstanding from said middle portion and integral therewith, said first lugs having aligned openings for the receipt of a first shaft releasably receiving and engaging said boom clevis, a first shaft in said first lugs aligned openings, said first shaft centrally of the length thereof being of restricted diameter to accommodate passage thereby of said hoses, said first shaft also engaging said boom clevis, a second plurality of spaced apart lugs depending from said middle portion and integral therewith, said second lugs having aligned openings for the receipt of a second shaft to releasably receive and engage said grapple clevis, a second shaft in said second lugs aligned openings, said second shaft centrally of the length thereof being of restricted diameter to accommodate passage thereby of said hoses, said first and second shafts being arranged perpendicularly of each other to provide for rotation of said grapple in two mutually perpendicular vertical arcs, each shaft extending at both ends beyond its associated lugs and equipped with snubber means in the extended portions.

7. The grapple of claim 6 in which said lugs are arranged in two sets of two each with a set of lugs being on opposite sides of said central opening.

8. A 360° swivel skidder grapple comprising:

a boom having a grapple-supporting end, a rotation mechanism in said grapple supporting end including a depending clevis and swiveling hydraulic fluid supply means, a pair of hoses depending from said fluid supply means in side-by-side relation to said clevis, a tong-equipped grapple having a head at its upper end with a clevis upstanding therefrom and with hydraulic cylinder means for actuating said tongs, a linkage connecting said boom clevis to said grapple clevis, said linkage including a middle portion having a central opening extending therethrough for the passage of said hoses, a first plurality of spaced apart lugs upstanding from said middle portion and integral therewith, said first lugs having aligned openings for the receipt of a first shaft releasably receiving and engaging said boom clevis, a first shaft in said first lugs aligned openings, said first shaft centrally of the length thereof being of restricted diameter to accommodate passage thereby of said hoses, said first shaft also engaging said boom clevis, a second plurality of spaced apart lugs depending from said middle portion and integral therewith, said second lugs having aligned openings for the receipt of a second shaft to releasably receive and engage said grapple clevis, a second shaft in said second lugs aligned openings, said second shaft centrally of the length thereof being of restricted diameter to accommodate passage thereby of said hoses, said first and second shafts being arranged perpendicularly of each other to provide for rotation of said grapple in two mutually perpendicular vertical arcs, each shaft extending at both ends beyond its associated lugs and equipped with snubber means in the extended portions, said lugs being arranged in two sets of two each with a set of lugs being on opposite sides of said central opening, said snubber means including Belleville washers adjacent one shaft end and friction discs adjacent the other shaft end, each shaft having an enlargement at one end and a nut at the other end, said snubber means being confined between said enlargement and a lug of one set at one end and between said nut and a lug of the second set at the second end.

9. A 360° swivel skidder grapple comprising:

a boom having a grapple-supporting end, a rotation mechanism in said grapple supporting end including a depending clevis and swiveling hydraulic fluid supply means, a pair of hoses depending from said fluid supply means in side-by-side relation to said clevis, a tong-equipped grapple having a head at its upper end with a clevis upstanding therefrom and with hydraulic cylinder means for actuating said tongs, a linkage connecting said boom clevis to aid grapple clevis, said linkage including a middle portion having a central opening extending therethrough for the passage of said hoses, a first plurality of spaced apart lugs upstanding from said middle portion and integral therewith, said first lugs having aligned openings for the receipt of a first shaft releasably receiving and engaging said boom clevis, a first shaft in said first lugs aligned openings, said first shaft centrally of the length thereof being of restricted diameter to accommodate passage thereby of said hoses, said first shaft also engaging said boom clevis, a second plurality of spaced apart lugs depending from said middle portion and integral therewith, said second lugs having aligned openings for the receipt of a second shaft to releasably receive and engage said grapple clevis, a second shaft in said second lugs aligned openings, said second shaft centrally of the length thereof being of restricted diameter to accommodate passage thereby of said hoses, said first and second shafts being arranged perpendicularly of each other to provide for rotation of said grapple in two mutually perpendicular vertical arcs, each shaft extending at both ends beyond its associated lugs and equipped with snubber means in the extended portions, said linkage middle portion being equipped with integral, spaced apart laterally extending projections of immobilizing said shafts.

10. The grapple of claim 9 in which said snubber means includes radial extension equipped friction discs, said extensions being confined between said projections for immobilizing said friction discs.

* * * * *